US009103624B1

(12) United States Patent
Kung et al.

(10) Patent No.: US 9,103,624 B1
(45) Date of Patent: Aug. 11, 2015

(54) BALLISTIC TRAJECTORY ADJUSTMENT MECHANISM FOR TOY GUN

(71) Applicant: Vega Force International Corp., New Taipei (TW)

(72) Inventors: Shih-Che Kung, New Taipei (TW); Chieh-Fu Chang, New Taipei (TW)

(73) Assignee: VEGA FORCE INTERNATIONAL CORP., New Taipei (TW)

( * ) Notice: Subject to any disclaimer, the term of this patent is extended or adjusted under 35 U.S.C. 154(b) by 0 days.

(21) Appl. No.: 14/279,058

(22) Filed: May 15, 2014

(51) Int. Cl.

| | |
|---|---|
| ***F41B 11/00*** | (2013.01) |
| ***F41B 11/70*** | (2013.01) |
| ***F41A 21/00*** | (2006.01) |
| ***F41B 11/62*** | (2013.01) |
| *F41A 21/32* | (2006.01) |
| *F41B 11/89* | (2013.01) |

(52) U.S. Cl.
CPC ..... *F41B 11/70* (2013.01); *F41B 11/00* (2013.01); *F41B 11/62* (2013.01); *F41A 21/32* (2013.01); *F41B 11/89* (2013.01)

(58) Field of Classification Search
CPC ..... F41B 11/00; F41B 11/62; F41B 11/89; F41B 11/70; F41A 21/32
USPC ..... 124/58, 73, 83, 84, 85; 42/76.01
See application file for complete search history.

(56) References Cited

U.S. PATENT DOCUMENTS

| | | | | |
|---|---|---|---|---|
| 2,182,369 | A * | 12/1939 | Barron | 124/81 |
| 2,922,242 | A * | 1/1960 | Pachmayr et al. | 42/79 |
| 3,029,540 | A * | 4/1962 | Pachmayr | 42/79 |
| 3,550,300 | A * | 12/1970 | Roder | 42/106 |
| 3,838,676 | A * | 10/1974 | Kahelin | 124/75 |
| 3,867,778 | A * | 2/1975 | Preda et al. | 42/79 |
| 5,655,510 | A * | 8/1997 | Kunimoto | 124/81 |
| 6,273,080 | B1 * | 8/2001 | Sullivan, Jr. | 124/84 |
| 6,295,752 | B1 * | 10/2001 | Havlock | 42/76.01 |
| 6,385,891 | B1 * | 5/2002 | Rabatin | 42/79 |
| 6,494,195 | B2 * | 12/2002 | Perry et al. | 124/84 |
| 6,698,128 | B2 * | 3/2004 | Kessler | 42/76.01 |
| 6,823,857 | B2 * | 11/2004 | Perry et al. | 124/84 |

(Continued)

FOREIGN PATENT DOCUMENTS

EP 2518431 A2 10/2012

OTHER PUBLICATIONS

Search Report Dated Feb. 2, 2015 of Corresponding German Utility Model No. 202014103063.8.

*Primary Examiner* — Melba Bumgarner
*Assistant Examiner* — Alexander Niconovich
(74) *Attorney, Agent, or Firm* — Chun-Ming Shih; HDLS IPR Services

(57) ABSTRACT

A ballistic trajectory adjustment mechanism for a toy gun includes an inner barrel penetrating through a gun base, a rubbing sleeve mounted on the inner gun barrel and a rubbing portion positioned inside the inner gun barrel. The inner gun barrel penetrates through a gear set. A flexible press plate includes one end inserting into the gear set and another extended to the rubbing sleeve. An adjustment barrel rotates under the exertion of an external force to drive the gear set to rotate in order to allow a restricting end of the flexible press plate to generate upward and downward movements and to press onto the rubbing sleeve for changing the position of the rubbing portion. With such configuration, the position of the rubbing portion can be adjusted via the adjustment barrel; therefore, the objective of correcting the ballistic trajectory is achieved.

19 Claims, 9 Drawing Sheets

(56) References Cited

U.S. PATENT DOCUMENTS

| | | | | |
|---|---|---|---|---|
| 7,040,310 | B2 * | 5/2006 | Finstad | 124/81 |
| 7,076,905 | B2 * | 7/2006 | Zouboulakis | 42/76.01 |
| 7,603,998 | B2 * | 10/2009 | Finstad | 124/81 |
| 7,628,149 | B1 * | 12/2009 | Zarecky et al. | 124/85 |
| 7,691,759 | B2 * | 4/2010 | Perry et al. | 442/77 |
| 7,980,238 | B2 * | 7/2011 | Wood | 124/84 |
| 8,037,877 | B2 * | 10/2011 | Liao | 124/44.7 |
| 8,397,706 | B2 * | 3/2013 | Wood | 124/84 |
| 8,714,146 | B2 * | 5/2014 | Hu | 124/84 |
| 2001/0050077 | A1 * | 12/2001 | Sullivan, Jr. | 124/84 |
| 2002/0121040 | A1 * | 9/2002 | Kumler | 42/79 |
| 2003/0041849 | A1 * | 3/2003 | Perry et al. | 124/84 |
| 2007/0017498 | A1 * | 1/2007 | Finstad | 124/84 |
| 2007/0069064 | A1 * | 3/2007 | Mott | 244/3.23 |
| 2007/0125351 | A1 * | 6/2007 | Campo et al. | 124/56 |
| 2008/0078370 | A1 * | 4/2008 | Kaakkola et al. | 124/73 |
| 2010/0154766 | A1 * | 6/2010 | Skilling | 124/71 |
| 2011/0000474 | A1 * | 1/2011 | Wood | 124/73 |
| 2011/0265777 | A1 * | 11/2011 | Wood | 124/84 |
| 2012/0272941 | A1 * | 11/2012 | Hu | 124/83 |
| 2014/0007857 | A1 * | 1/2014 | Schlosser | 124/81 |

* cited by examiner

BALLISTIC TRAJECTORY ADJUSTMENT MECHANISM FOR TOY GUN

BACKGROUND OF THE INVENTION

1. Field of the Invention

The present invention is related to a toy gun, in particular, to a ballistic trajectory adjustment mechanism for a toy gun.

2. Description of Related Art

The method of bullet shooting nowadays mainly comprises the step of loading bullets into the ballistic trajectory of the gun barrel and allowing the bullets to be driven by the external force to shoot out in order to strike a target outside the gun barrel. In addition, to allow the bullet to travel in a straight line within the ballistic trajectory, conventionally, a spiral gunbore line (or known as the rifling line) is provided inside the gun barrel such that when the bullet travels forward inside the gun barrel, the bullet is able to generate a high speed rotation forced by the gunbore line in order to be maintained at a straight line direction. As a result, a gun barrel with a gunbore line structure is able to not only increase the shooting range of the bullet but also ensure stable flying of the bullet in order to strike the target with great accuracy.

However, since most of the conventional toy guns have simpler structures, there is no such gunbore line provided inside their gun barrels to guide the rotations of the bullet. In the situation where the ballistic trajectory is not corrected, although the gun may be accurately aimed at the target for shooting, the bullet may still deviate from the target after firing from the toy gun. In addition, despite the fact that currently existing toy guns have already utilized a rubbing member for adjusting the ballistic trajectory, its implementation method is to allow the bullet being fired to contact with the rubbing member in order to generate the effect of rotation of the bullet such that the objective of correcting the ballistic trajectory can be achieved. Nevertheless, the position of the aforementioned rubbing rubber can only be adjusted by opening up the gun barrel in the first place, which is extremely inconvenient for use and requires an improvement.

In view of the above, the inventor seeks to provide a novel solution to overcome the aforementioned drawbacks associated with the known arts along with years of experience and application of theoretical principles in the field.

SUMMARY OF THE INVENTION

An objective of the present invention is to provide a ballistic trajectory adjustment mechanism for a toy gun, which uses a gear set for driving the adjustment of position of a rubbing sleeve inside a gun barrel in order to achieve the objective of adjusting the ballistic trajectory thereof.

To achieve the aforementioned objective, the present invention provides a ballistic trajectory adjustment mechanism for a toy gun comprising a gun base, an inner gun barrel penetrating through the gun base, a rubbing sleeve, a gear set, a flexible press plate and an adjustment barrel. The rubbing sleeve is mounted on one end opening of the inner gun barrel; the rubbing sleeve includes a rubbing portion having a portion thereof positioned inside the inner gun barrel. The gear set is installed on one side of the rubbing sleeve; the gear set comprises a primary gear and a secondary gear driven by the primary gear; the secondary gear includes an axial hole and an arched slot; the inner gun barrel penetrates through the axial hole; the arched slot extends from one side of the axial hole toward a direction away from the axial hole. The flexible press plate comprises a restricting end and a pressing end; the restricting end is inserted into the arched slot; the pressing end extends to a position of the rubbing sleeve. The adjustment barrel comprises a fixation end and a free end opposite from each other; the fixation end includes a rotating axle attached to the primary gear; wherein the free end is subject to an external force to generate a rotation in order to drive the primary gear to rotate; the secondary gear is driven by the primary gear to rotate together; the restricting end of the flexible press plate moves upward and downward along a wall of the arched slot in order to allow the pressing end to press onto the rubbing sleeve and to change the position of the rubbing portion thereof in the inner gun barrel.

Another objective of the present invention is to provide a ballistic trajectory adjustment mechanism for a toy gun in which an opening slot of the adjustment barrel is exposed in order to facilitate an external tool to penetrate therethrough and to drive the gear set to rotate; therefore, the objective of adjusting the ballistic trajectory with ease can be achieved.

In comparison to the prior art, the ballistic trajectory adjustment mechanism for a toy gun of the present invention allows the use of an external tool to drive the adjustment barrel to generate rotations in order to drive the gear set inside the gun base to operate such that the flexible press plate can be driven to press onto the rubbing sleeve and to further change the position of the rubbing portion inside the gun barrel. Subsequently, the bullet being fired is able to contact with the rubbing portion inside the ballistic trajectory in order to generate rotations such that the objective of correcting the ballistic trajectory can be achieved. Furthermore, since the adjustment of the position of the rubbing portion of the present invention requires no opening up of the gun base or the gun barrel, the method of adjusting the ballistic trajectory involved is more convenient, which also enhances the practical applications of the present invention.

DETAILED DESCRIPTION OF THE INVENTION

Figure 1:
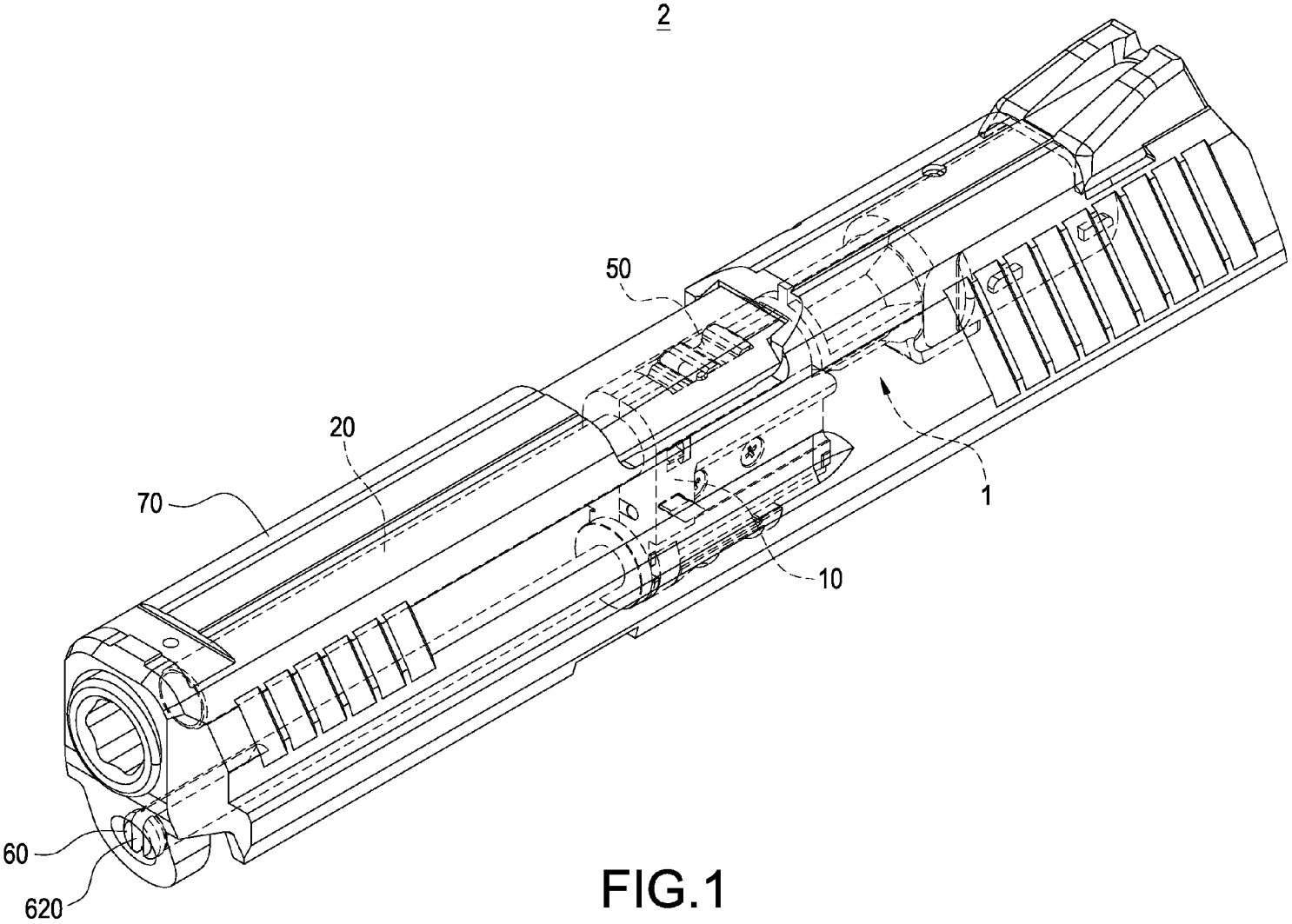
FIG. 1 is a perspective view of the gun barrel of the toy gun of the present invention.
Figure 2:
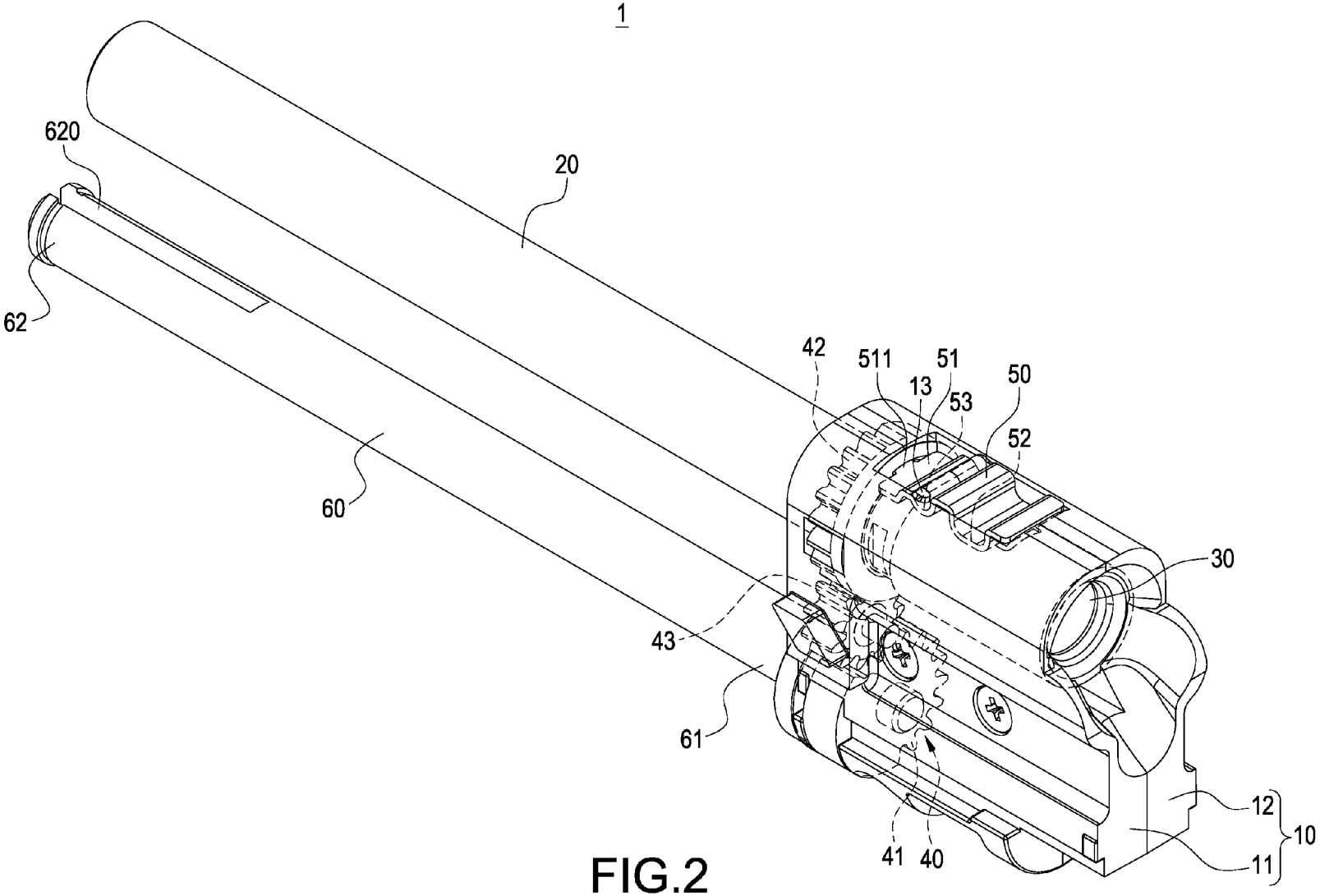
FIG. 2 is a perspective view of the ballistic trajectory adjustment mechanism for a toy gun of the present invention.
Figure 3:
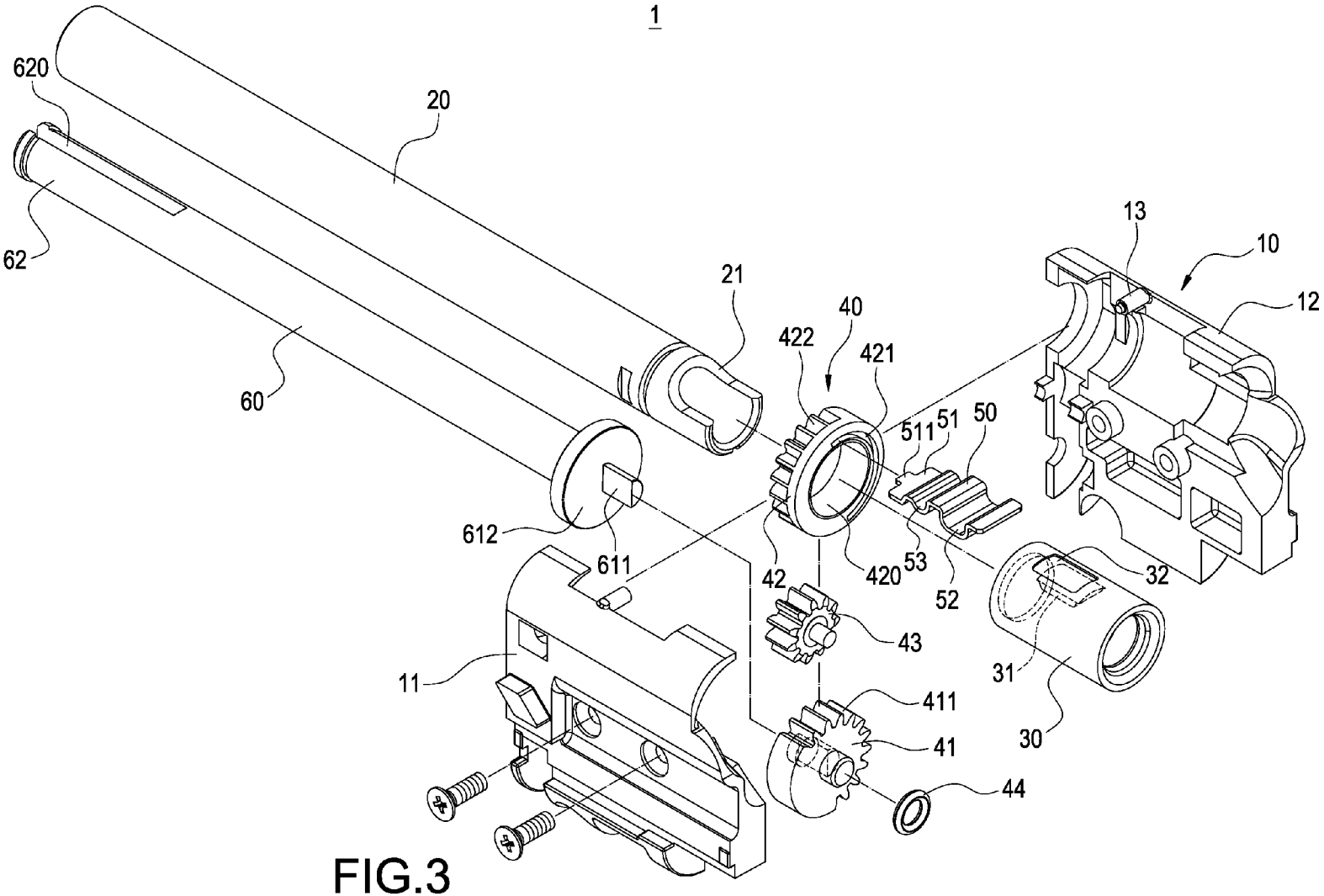
FIG. 3 is an exploded view of the ballistic trajectory adjustment mechanism for a toy gun of the present invention.
Figure 4:
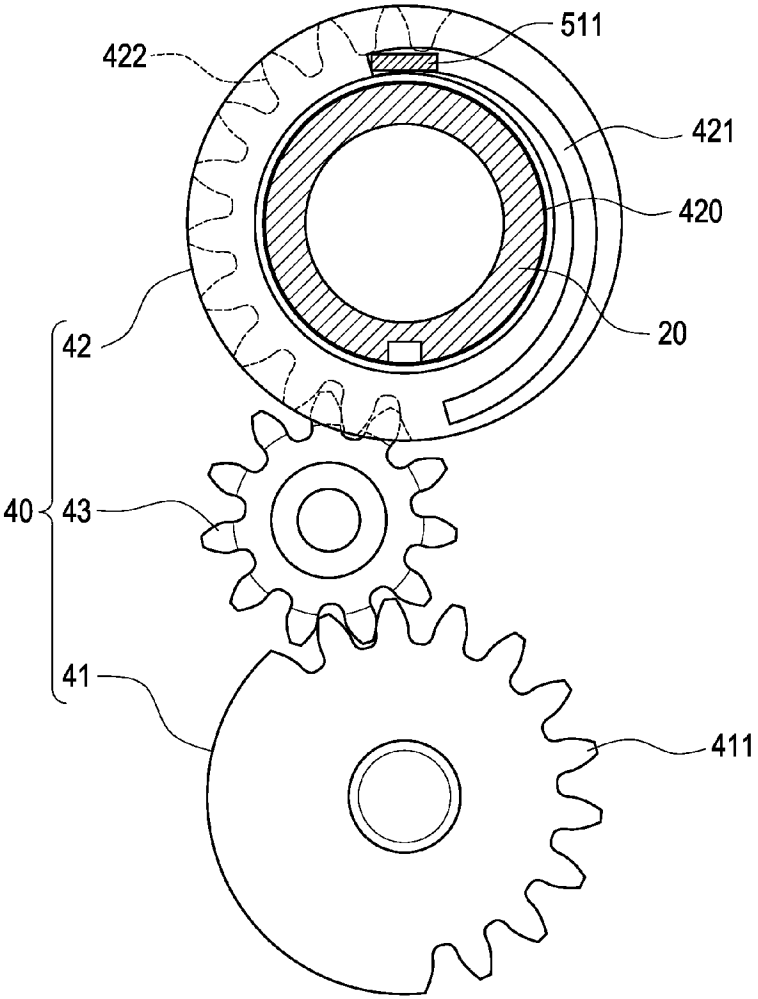
FIG. 4 is an assembly view of the gear set of the ballistic trajectory adjustment mechanism for a toy gun of the present invention.

The following provides detailed description of embodiments of the present invention along with the accompanied drawings. It can, however, be understood that the accompanied drawings are provided for illustrative purposes only and shall not be treated as limitations to the present invention.

Please refer to FIG. 1 to FIG. 4, showing a perspective view of the gun barrel of the toy gun, a perspective view and exploded view of the ballistic trajectory adjustment mechanism as well as an assembly view of the gear set of the toy gun of the present invention respectively. The ballistic trajectory adjustment mechanism 1 for a toy gun of the present invention comprises a gun base 10, an inner gun barrel 20, a rubbing sleeve 30, a gear set 40, a flexible press plate 50 and an adjustment barrel 60. The inner gun barrel 20, the rubbing sleeve 30, the gear set 40, the flexible press plate 50 and the adjustment barrel 60 are all arranged inside the gun base 10. The rotation of the adjustment barrel 60 is able to drive the gear set 40 to rotate together in order to further drive the flexible press plate 50 to generate a movement and to press onto the rubbing sleeve 30 such that the position of the rubbing sleeve 30 on the ballistic trajectory can be adjusted. Accordingly, the bullet after firing is able to contact with the rubbing sleeve 30 and to rotate in order to change its course of traveling; therefore the objective of adjusting the ballistic trajectory can be achieved.

Preferably, the toy gun further comprises an outer shield housing 70. The outer shield housing 70 covers the outer of the gun base 10, the inner gun barrel 20 and the adjustment barrel 60 such that a gun barrel 2 with the ballistic trajectory adjustment mechanism 1 can be constructed.

The gun base 10 comprises two housing plates 11, 12 matched to each other left to right. The inner gun barrel 20 penetrates through the gun base 10. The rubbing sleeve 30 is mounted on one end of the inner gun barrel 20, and the rubbing sleeve 30 includes a rubbing portion 31 having a portion thereof positioned inside the inner gun barrel 20.

In this embodiment, one end of the inner gun barrel 20 includes a notch 21 such that when the rubbing sleeve 30 is mounted on one end of the inner gun barrel 20, the rubbing portion 31 of the rubbing sleeve 30 is positioned inside the notch 21. In addition, the rubbing sleeve 30 is made of an elastic material, and an outer wall of the rubbing sleeve 30 includes a concave region 32 formed corresponding to a position of the rubbing portion 31.

The gear set 40 is installed on one side of the rubbing sleeve 30. The gear set 40 comprises a primary gear 41 and a secondary gear 42 driven by the primary gear 41. The secondary gear 42 includes an axial hole 420 and an arched slot 421. The inner gun barrel 20 penetrates through the axial hole 420, and the arched slot 421 includes a cam surface extended from one side of the axial hole 420 toward a direction away from the axial hole 420.

According to one embodiment of the present invention, a portion of the circumferential surface of the secondary gear 42 includes a plurality of secondary gear teeth 422, and the arched slot 421 is disposed on another side of the circumferential surface opposite therefrom. A portion of the circumferential surface of the primary gear 41 includes a plurality of primary gear teeth 411. Furthermore, the gear set 40 further comprises an idle gear 43 and a collar 44. The idle gear 43 is disposed between the primary gear 41 and the secondary gear 42 in order to allow the primary gear 41 and the secondary gear 42 to rotate in the same direction. The collar 44 is disposed on the outer side of the primary gear 41, and the collar 44 is provided to facilitate the rotation of the primary gear 41 in a smooth manner.

Furthermore, the flexible press plate 50 is a flexible sheet with consecutive bending curves, which comprises a restricting end 51 and pressing end 52. The restricting end 51 is inserted into the arched slot 421 of the secondary gear 42, and the pressing end 51 extends to the position of the rubbing sleeve 30.

In this embodiment, the inner wall of the gun base 10 (housing plates 11, 12) includes a press column 13. A positioning curve surface 53 is formed between the restricting end 51 and the pressing end 52 of the flexible press plate 50. The press column 13 extends to the positioning curve surface 53. With such configuration, during the rotation of the secondary gear 42, the press column 13 presses against the positioning curve surface 53 in order to block the flexible press plate 50 to remain at its position inside the arched slot 421 and to allow the pressing end 52 to generate upward and downward movements. Preferably, the restricting end 51 of the flexible press plate 50 includes a protrusion 511 inserted into the arched slot 421.

The adjustment barrel 60 comprises a fixation end 61 and a free end 62 opposite from each other. The fixation end 61 includes a rotating axle 611 attached to the primary gear 41. In this embodiment, the adjustment barrel 60 further includes a blocking plate 612 formed on one side of the rotating axle 611. The primary gear 41 is axially disposed on the blocking plate 612. Preferably, the rotating axle 611 includes a positioning surface, the primary gear 41 includes an attachment slot, and the rotating axle 611 is attached to and positioned inside the attachment slot. In addition, the free end 62 of the adjustment barrel 60 includes an opening slot 620. The opening slot 620 can be, preferably, configured to be a rectangular slot. When the outer shield housing 70 covers the outer of the gun base 10, the inner gun barrel 20 and the adjustment barrel 60, the opening slot 620 is exposed at the outer shield housing 70 in order to allow the user to insert an external tool into the opening slot 620 and to drive the adjustment barrel 60 to rotate.

Figure 5:
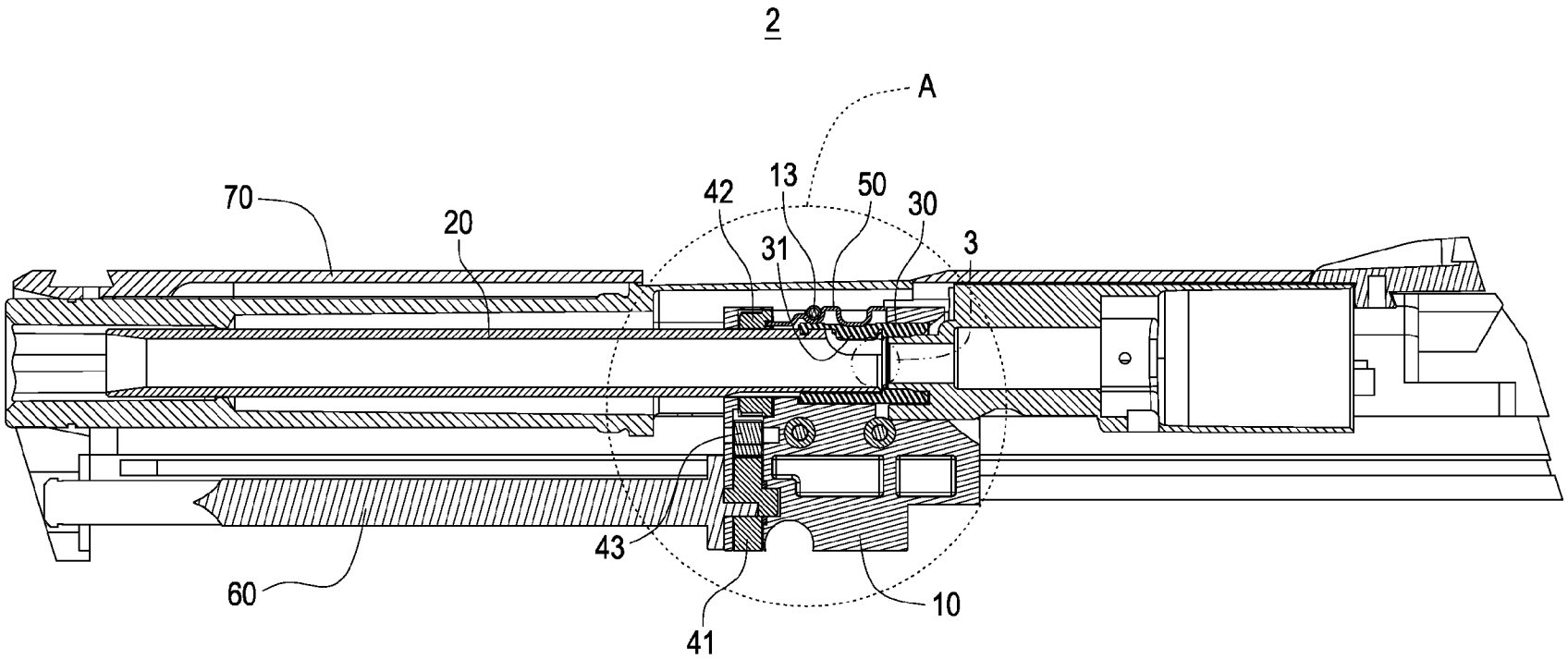
FIG. 5 is a cross sectional view of the assembly of the ballistic trajectory adjustment mechanism for a toy gun of the present invention.
Figure 6:
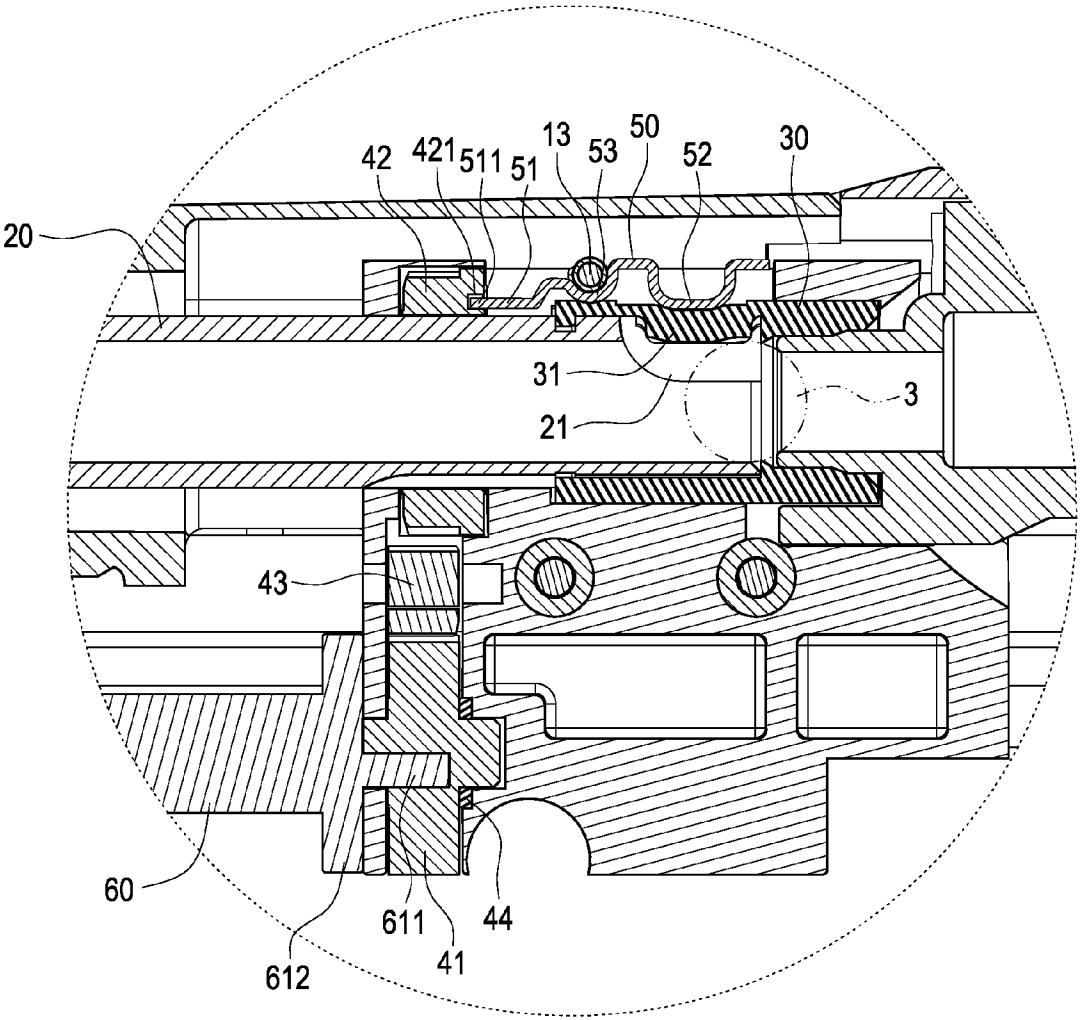
FIG. 6 is an enlarged view of Part A in FIG. 5.

Please refer to FIG. 5 and FIG. 6, showing a cross sectional view of the assembly of the ballistic trajectory adjustment mechanism for a toy gun of the present invention and a partially enlarged view thereof respectively. The ballistic trajectory adjustment mechanism of the present invention is used for adjusting a bullet 3 at the ballistic trajectory. The rubbing portion 31 protrudes on the ballistic trajectory. Therefore, the bullet 3 after firing is able to generate rotates due to its contact with the rubbing portion 31 and the course of traveling of the bullet being fired can be changed in terms of the shooting range or angle of shooting accordingly.

In addition, when the free end 62 of the adjustment barrel 60 rotates due to the exertion of an external force, it is able to further drive the primary gear 41 to rotate, which means that the secondary gear 42 is driven by the primary gear 41 to rotate altogether. Therefore, the restricting end 51 of the flexible press plate 50 moves upward and downward along the wall of the arched slot 421 in order to allow the pressing end 52 to press onto the rubbing sleeve 30 and to change the position of the rubbing portion 31 inside the inner gun barrel 20.

Figure 7:
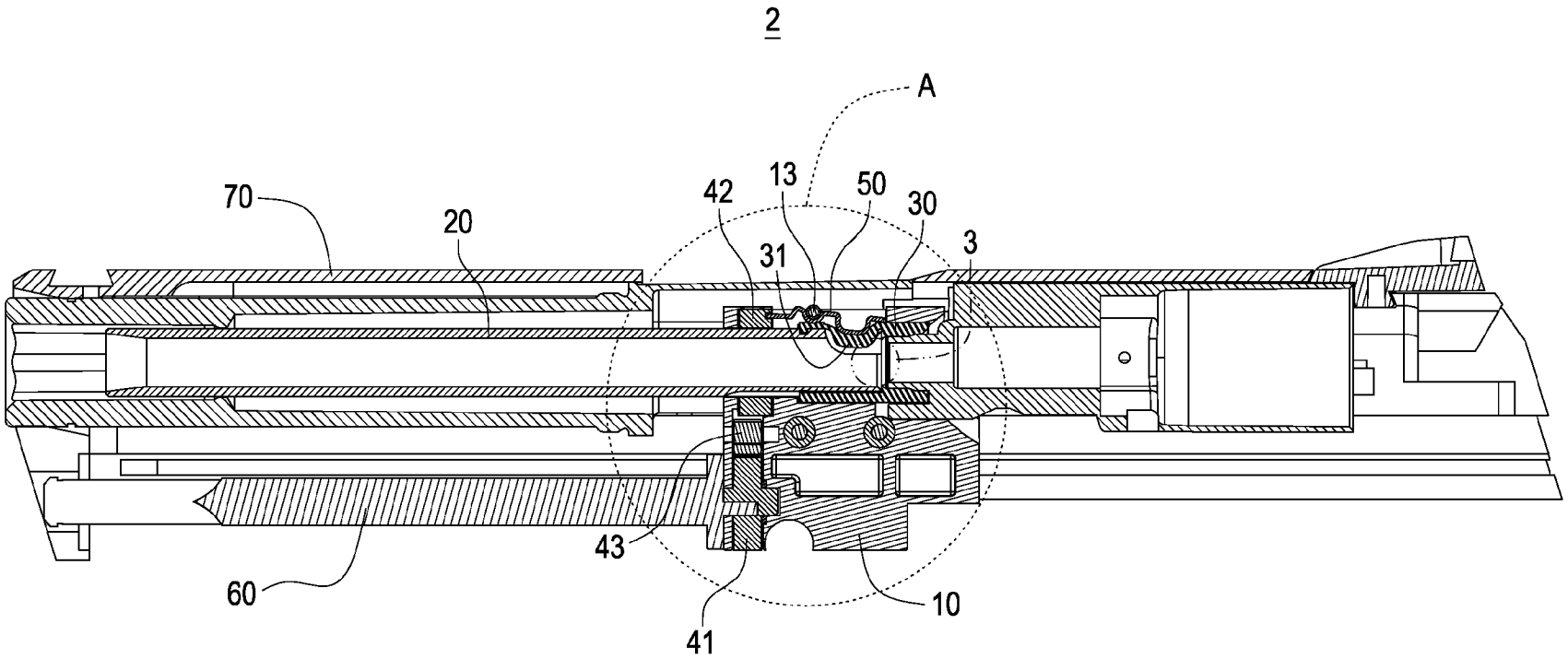
FIG. 7 is an illustration showing the adjustment of the ballistic trajectory adjustment mechanism for a toy gun of the present invention.
Figure 8:
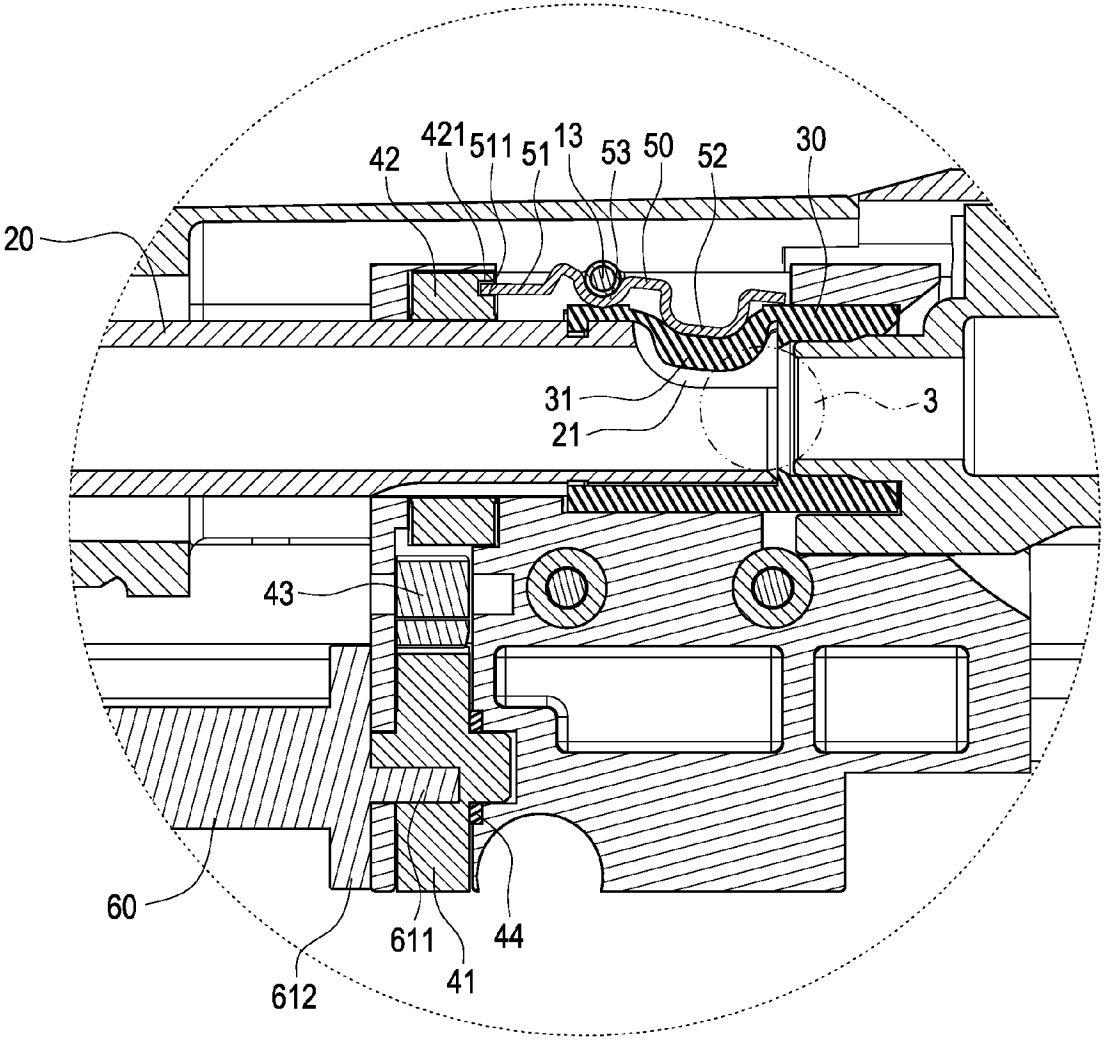
FIG. 8 is an enlarged view of Part A in FIG. 7.
Figure 9:
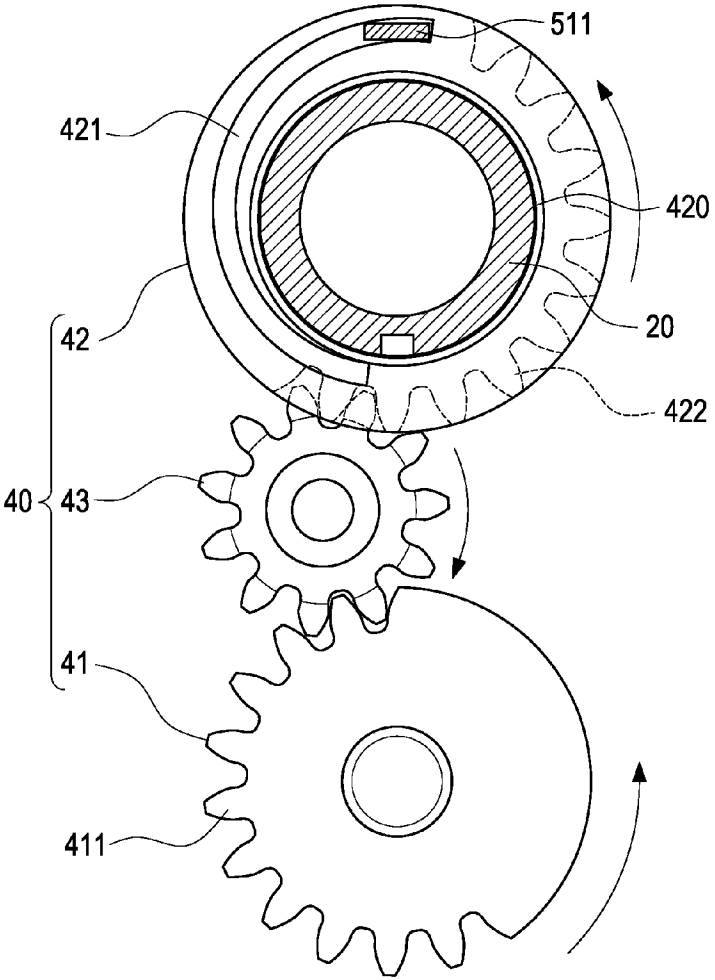
FIG. 9 is an illustration showing the actuation of the gear set of the ballistic trajectory adjustment mechanism for a toy gun of the present invention.

Please refer to FIG. 7 to FIG. 9, showing an illustration of the adjustment of the ballistic trajectory adjustment mechanism, a partially enlarged view thereof and an illustration of the actuation of the gear set of the ballistic trajectory adjustment mechanism for a toy gun of the present invention. When the user wishes to adjust the ballistic trajectory, he or she can use an external tool, such as a coin or a piece of slat, to insert into the opening slot 620 of the adjustment barrel 60 in order to drive the adjustment barrel 60 to generate rotations. During the same time, the primary gear 41 would then rotate along with the rotation of the adjustment barrel 60 while the idle gear 43 and the secondary gear 42 also rotates correspondingly. In addition, the restricting end 51 of the flexible press plate 50 then moves upward along the wall of the arched slot 421, as shown in FIG. 9; whereas the pressing end 52 of the flexible press plate 50 generates a downward movement to press onto the rubbing sleeve 30 and to change the position of the rubbing sleeve 31 at the ballistic trajectory. According to the above, the course of traveling of the bullet being fired would be different as it comes in contact with the rubbing portion 31 at different positions; consequently, the bullet 3 is able to generate rotations such that the shooting range and the angle of the shooting can be altered.

The above descriptions on the embodiments of the present invention are provided for illustrative purposes only, which shall not be treated as limitations of the present invention. Any other equivalent modifications within the spirit of the present invention shall be deemed to be within the scope of the present invention.

What is claimed is:

1. A ballistic trajectory adjustment mechanism for a toy gun, comprising:

a gun base;

an inner gun barrel penetrating through the gun base;

a rubbing sleeve mounted on one end opening of the inner gun barrel; the rubbing sleeve comprising a rubbing portion having a portion thereof positioned inside the inner gun barrel;

a gear set installed on one side of the rubbing sleeve; the gear set comprising a primary gear and a secondary gear driven by the primary gear; the secondary gear having an axial hole and an arched slot; the inner gun barrel penetrating through the axial hole; the arched slot extended from one side of the axial hole toward a direction away from the axial hole;

a flexible press plate comprising a restricting end and a pressing end; the restricting end inserted into the arched slot; the pressing end extended to a position of the rubbing sleeve; and an adjustment barrel comprising a fixation end and a free end opposite from each other; the fixation end having a rotating axle attached to the primary gear;

wherein the free end is subject to an external force to generate a rotation in order to drive the primary gear to rotate; the secondary gear is driven by the primary gear to rotate together; the restricting end of the flexible press plate moves upward and downward along a wall of the arched slot in order to allow the pressing end to press onto the rubbing sleeve and to change the position of the rubbing portion thereof in the inner gun barrel.

2. The ballistic trajectory adjustment mechanism for a toy gun according to claim 1, wherein the gun base comprises two housing plates matched to each other left to right.

3. The ballistic trajectory adjustment mechanism for a toy gun according to claim 1, wherein an inner wall of the gun base includes a press column; a positioning curve surface is formed on the flexible press plate between the restricting end and the pressing end; the press column extends to the positioning curve surface.

4. The ballistic trajectory adjustment mechanism for a toy gun according to claim 1, wherein one end of the inner gun barrel includes a notch; the rubbing portion of the rubbing sleeve is positioned inside the notch.

5. The ballistic trajectory adjustment mechanism for a toy gun according to claim 1, wherein the rubbing sleeve is made of an elastic material, and an outer wall of the rubbing sleeve includes a concave region formed corresponding to a position of the rubbing portion.

6. The ballistic trajectory adjustment mechanism for a toy gun according to claim 1, wherein a portion of a circumferential surface of the secondary gear includes a plurality of secondary gear teeth, and the arched slot is formed at another side of the circumferential surface opposite therefrom.

7. The ballistic trajectory adjustment mechanism for a toy gun according to claim 6, wherein the arched slot is correspondingly positioned at one side without the plurality of secondary gear teeth.

8. The ballistic trajectory adjustment mechanism for a toy gun according to claim 6, wherein a portion of a circumferential surface of the primary gear includes a plurality of primary gear teeth.

9. The ballistic trajectory adjustment mechanism for a toy gun according to claim 1, wherein the gear set further comprises a collar; the collar is axially disposed on an outer side of the primary gear.

10. The ballistic trajectory adjustment mechanism for a toy gun according to claim 1, wherein the gear set further comprises an idle gear disposed between the primary gear and the secondary gear.

11. The ballistic trajectory adjustment mechanism for a toy gun according to claim 1, wherein the arched slot includes a cam surface.

12. The ballistic trajectory adjustment mechanism for a toy gun according to claim 1, wherein the flexible press plate is a flexible sheet with consecutive bending curves.

13. The ballistic trajectory adjustment mechanism for a toy gun according to claim 1, wherein the restricting end of the flexible press plate includes a protrusion inserted into the arched slot.

14. The ballistic trajectory adjustment mechanism for a toy gun according to claim 1, wherein the rotating axle includes a positioning surface; the primary gear includes an attachment slot; the rotating axle is attached to and positioned inside the attachment slot.

15. The ballistic trajectory adjustment mechanism for a toy gun according to claim 1, wherein the adjustment barrel further includes a blocking plate formed on one side of the rotating axle; the primary gear is axially disposed on the blocking plate.

16. The ballistic trajectory adjustment mechanism for a toy gun according to claim 1, wherein the free end of the adjustment barrel includes an opening slot.

17. The ballistic trajectory adjustment mechanism for a toy gun according to claim 16, wherein the opening slot is a rectangular slot.

18. The ballistic trajectory adjustment mechanism for a toy gun according to claim 16, wherein the toy gun further comprises an outer shield housing covering an outer of the gun base, the inner gun barrel and the adjustment barrel.

19. The ballistic trajectory adjustment mechanism for a toy gun according to claim 18, wherein the opening slot is exposed on the outer shield housing.

* * * * *